US005505478A

United States Patent [19]

Napoliello

[11] Patent Number: 5,505,478

[45] Date of Patent: Apr. 9, 1996

[54] RELEASABLE MOUNTING FOR A SNOWBOARD BINDING

[76] Inventor: Michael Napoliello, 4 Whittier Ct., Freehold, N.J. 07728

[21] Appl. No.: 291,613

[22] Filed: Aug. 17, 1994

[51] Int. Cl.[6] ..... A63C 9/00

[52] U.S. Cl. ..... 280/618; 280/142

[58] Field of Search ..... 280/607, 617, 280/618, 633, 634, 14.2

[56] References Cited

U.S. PATENT DOCUMENTS

| | | | |
|---|---|---|---|
| 4,973,073 | 11/1990 | Raines et al. | 280/618 |
| 5,021,017 | 6/1991 | Ott | 280/142 |
| 5,035,443 | 7/1991 | Kincheloe | 280/618 |
| 5,299,823 | 4/1994 | Glaser | 280/14.2 |

*Primary Examiner*—Richard M. Camby
*Attorney, Agent, or Firm*—Patrick J. Pinto

[57] ABSTRACT

A releasable mounting for a snowboard binding which includes a base member which is adapted for attaching to a selected surface of a snowboard. The base member includes a channel-like profile and has a plurality of lug members attached to a top edge of its sidewalls. The lug members are spaced at predetermined intervals. This mounting also includes a foot engaging member which is adapted for attaching to a binding. This foot engaging member is shaped for minimizing the collection of snow thereon. The foot engaging member include a plurality of fee which engage the lug members. A locking means carried by said base member may be selectively placed in a open condition or locked condition when the foot engaging member is engaged in the base member.

7 Claims, 2 Drawing Sheets

RELEASABLE MOUNTING FOR A SNOWBOARD BINDING

BACKGROUND OF THE INVENTION

1. Field of the Invention

With regard to the classification of art, this invention is believed to be found in the general class entitled "LAND VEHICLES" and more particularly to those subclasses pertaining to a "RELEASABLE MOUNTING FOR A SNOWBOARD BINDING".

2. Description of Related Art

The use of snowboards is well known in the art. It is also well known that snowboards are most efficiently used when gliding down a sloped snow covered surface. The conventional safety binding system associated with snowboards has presented the snow boarder with some problems. One of the problems is experienced when the snowboard is used on relatively flat surfaces. The second problem is experienced while using a ski lift. To solve these problems releasable bindings have been proposed in U.S. Pat. No. 4,973,073 issued to Raines et al on Nov. 27, 1990; U.S. Pat. No. 5,035,443 issued to Kincheloe on Jul. 30, 1991; and U.S. Pat. No. 5,299,823 issued to Glaser on Apr. 5, 1994. Each of the identified prior art patents disclose mountings which require the users foot be either fully engaged and locked in place or in a fully released condition. They do not shown a mounting arrangement which has an intermediate condition which is particularly useful in everyday practical situations. Some of the prior art patents disclose the use of a substantially flat plate attachment to the pushing foot. It is believed that this arrangement would not aid in providing traction to the pushing foot on snow.

The present invention allows the user to keep at least one foot in an engaged condition with respect to the snowboard. The user may then selectively place the locking means of the present invention in a locked or unlocked condition to suit the need as it arises. For example; an engaged and unlocked condition is very useful when using a ski lift. The user may easily engage or disengage his foot without the need to reach down to unlock or lock a locking means. This feature may have advantages when propelling the snowboard on uneven surfaces. The contour of the present invention not only lightens the weight of the apparatus, it allows engagement under adverse conditions. The preferred contour and feet of the present invention also assists in providing traction when pushing off or skate boarding with one foot. Other advantages of the present invention over the prior art will become apparent below.

SUMMARY OF THE INVENTION

In brief the present invention may be summarized as a releasable mounting for a snowboard binding comprising: a) a base member arrayed for attaching to a selected surface of a snowboard, the base plate further including a pair of spaced side wall members forming a channel profile, a top edge of each of the side wall members having a plurality of laterally disposed lug members which are in substantial alignment and have a predetermined spacing, the predetermined spacing forming gaps therebetween; b) a foot engaging member having an elongated trough being formed along a major axis of its bottom surface, the elongated trough having sloped sides, the sloped sides being arrayed for forming an enlarged mouth portion, a plurality of laterally disposed feet, those feet being of a predetermined shape and being positioned at predetermined intervals along the mouth of the elongated trough, each of the feet being sized to fit into the gaps of said base member; c) a locking means being carried by the base member, the locking means including a handle portion, an engaging portion and a biasing means, the locking means being manually movable from an open position to a closed position by way of the handle portion; and wherein the feet of the foot engaging member are insertable into and through the gaps of the base member, subsequently the foot engaging member being laterally displaced along said major axis to a position under the lug members providing an engaged only condition when the locking means is in the open condition, the foot engaging member being selectively held in an engaged and locked condition when the locking means is placed in a locked position.

In addition to the above summary, the following disclosure is intended to be detailed to insure adequacy and aid in the understanding of the invention. However, this disclosure, showing embodiments of the invention, is not intended to describe each new inventive concept which may arise. These specific embodiments have been chosen to show at least one best mode for the releasable mounting for a snowboard binding of the present invention. These specific embodiments as shown in the accompanying drawings may also include diagrammatic symbols for the purpose of illustration and understanding.

Figure 1:
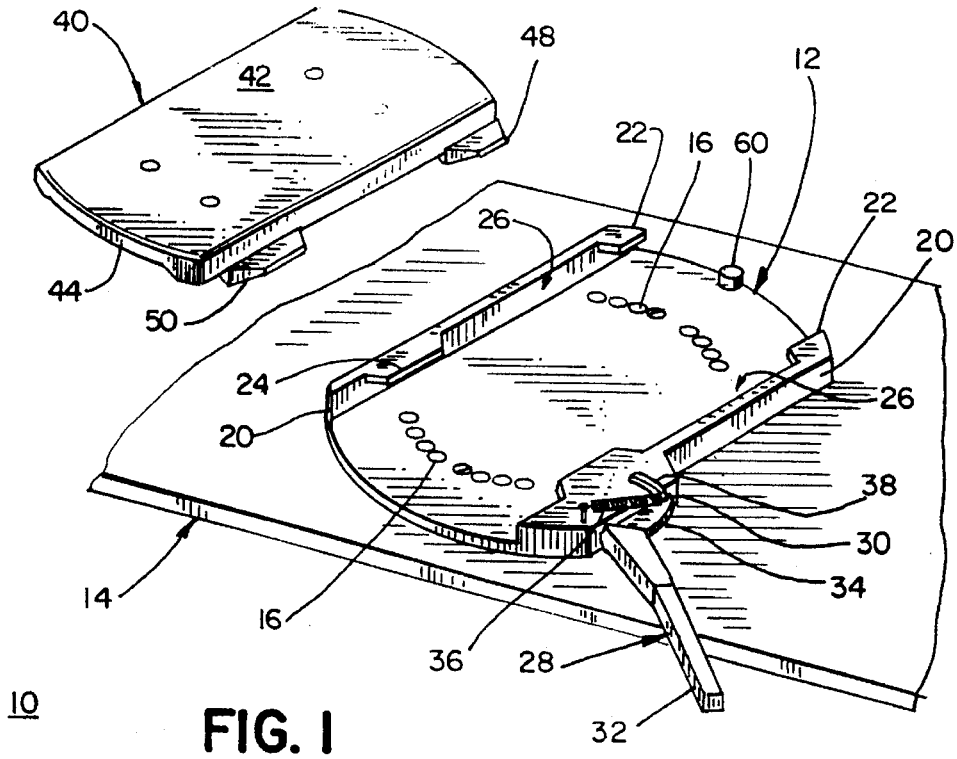
FIG. 1 represents an exploded isometric view of the present invention.

In the following description and in the claims, various details are identified by specific names for convenience. These names are intended to be generic in their application while differentiating between the various details. Corresponding reference numbers refer to like members throughout the several figures of the drawing.

The drawing accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Figure 2:
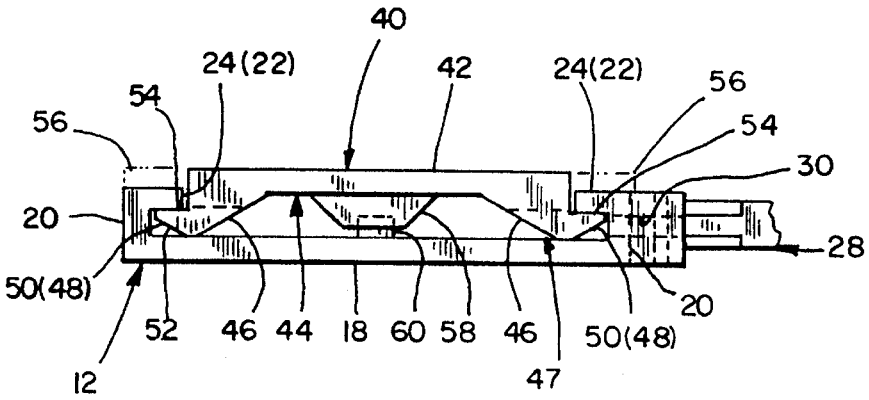
FIG. 2 represents front elevation view of the present invention.

Referring first to FIGS. 1 and 2, a releasable mounting for a snowboard binding is generally identified as 10. A base member 12 is arrayed for attaching to a preselected surface of a snowboard 14. Preferably the base plate is provided with a plurality of mounting holes 16 through its base plate 18. It is also preferred that these mounting holes be arrayed at spaced intervals along a bolt circle. This preferred mounting arrangement allows adjustment of the major axis of the base member 12 with respect to the major axis of the snowboard 14 without the need to drill new holes. Alternatively the base member 12 may be supplied without holes for use as a retrofit model. This retrofit model would allow the user to custom drill holes to match a particular existing mounting pattern in a binding. The base member 12 further includes a pair of sidewall members 20. These sidewall members 20 are arrayed in a spaced relationship to form a channel-like profile. A plurality of lug members 22 and 24 project laterally from a top edge of the sidewalls 20. These lug members 22 and 24 are in substantial alignment and have a predetermined spacing therebetween, forming a pair of gaps 26.

The base member 12 further includes a locking means 28. In the preferred arrangement, the locking means 28 is pivotally mounted in an elongated passage 30 which is formed in and through one of the sidewalls 20. This locking means 28 includes a handle portion 32, and engaging portion 34 and a biasing means 36. One example of the engaging portion 34 may be described as a quadrant of a disc. In this example, the pivot of the locking means 28 is placed near the theoretical center of that disc. One example of a biasing means 26 includes an extension spring which is extended between a post on the base member and a post on the locking means 28. The mounting of the biasing means 36 should provide an over-center action. This over-center action maintains the locking means 28 in either an open position or a locked position. It is preferred that the biasing means 36 be mounted along a top surface of the base member 12, but not limited thereto. This preferred arrangement requires that a slotted aperture 38 be formed in base member 12. The handle portion 32 of the locking means should be of a sufficient length to allow easy operation, without inhbiting the use of the snowboard. It is also preferred that the handle portion be angled upward for allowing clearance for the users hand.

The mounting assembly 10 also includes a foot engaging member 40. This foot engaging member 40 includes a top surface 42. This top surface 42 should be sized and shaped so that a binding, not shown, may be safely mounted thereon and thereto. This foot engaging member 40 is profiled so that an elongated trough 44 is formed into its bottom surface. The preferred elongated trough 44 includes outwardly sloping sides 46. An unsupported end of each of these sloped sides 46 of the elongated trough terminate define an enlarged mouth portion 47. This preferred shape resists the packing of snow therein. A plurality of feet 48 and 50 project downward and extend horizontally from the enlarged mouth portion 47. These feet 48 and 50 are spaced at predetermined intervals so that they will engage the lugs 22 and 24. It is preferred that the bottom surface 52 of the feet be sloped with respect to its substantially horizontal upper surface 54. It has been found that sloping the bottom surface 52 helps displace any accumulated snow during insertion of the foot engaging member 40 into the base member 12. This sloped surface 52 may have a flat or a concave profile, when viewed from the right or left. It is anticipated that some or all of the feet 48 and 50 may have a circular cross section. Alternatively the foot engaging member 40 may be formed with upper flange portions 56, which are shown in dashed outline in FIG. 2.

USE AND OPERATION

Figure 5:
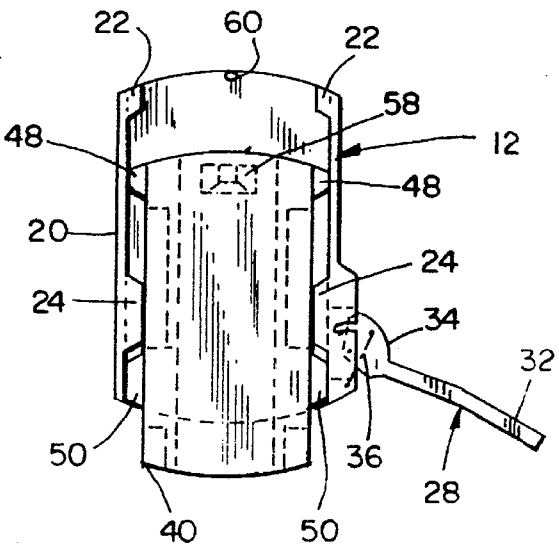
FIG. 5 represents a top elevation view of the present invention, this view showing the apparatus in a released and unlocked condition.
Figure 4:
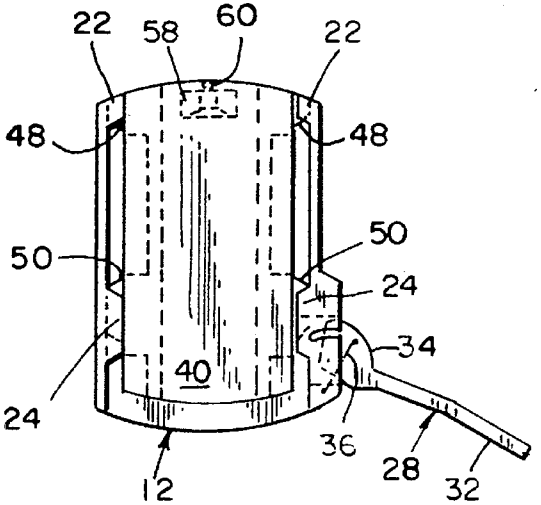
FIG. 4 represents a top elevation view of the present invention, this view showing the apparatus in an engaged and unlocked condition.
Figure 3:
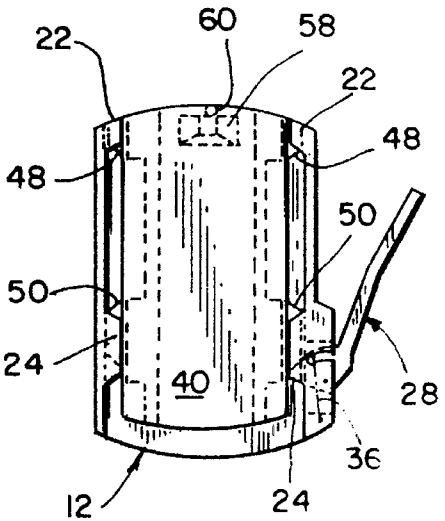
FIG. 3 represents a top plan view of the present invention, this view showing the apparatus in an engaged and locked condition.

Referring in particular to FIGS. 3, 4 and 5, The present invention allows the user to insert the foot engaging member 40 into the base member 12 by aligning those parts substantially as shown in FIG. 5. This allows the feet 48 and 50 to enter the gaps of the base member 12. The foot engaging member 40 is moved upward approximately 25.4 mm.(1 in.) along the major axis of the base member 12 until a projecting member 58 of the foot engaging member 40 abuts a stop member 60 of the base member 12, as shown in FIGS. 2, 3 and 4. When the locking means 28 placed in an open condition as shown in FIG. 4, the foot engaging member 40 is in an engaged only condition, meaning that the foot engaging member may be easily removed as necessary without unlocking the handle. Removal of the foot engaging member 40 from the base member is a reversal of the insertion procedure. The engaged only position, as shown in FIG. 4, has been found to be very useful when riding a ski lift. It may also be used when the user wishes to glide for short distances during manual propulsion.

Referring now to FIG. 3, which represents an engaged and locked condition of the foot engaging member 40. This engaged and locked condition is primarily used when snowboarding down a sloped surface. The preferred locking means 28 described above provides a cam type action which eliminates much of the clearance between the mating parts. The biasing means holds the locking means in a desired open or closed position. Other biasing means 36 such as ball detents, compression springs and the like may also be used.

It has been found that the projecting feet 48 and 50 and the shape of the foot engaging member 40 aid in providing traction when pushing off from a ski lift or during manual propulsion. If more traction is needed removable cleats, not shown, may be mounted in the trough 44. As previously stated, the shape of the bottom surface of the foot engaging member 40 provides pockets into which any snow present on the base member 12 may be displaced during its insertion into the base member 12.

It is also anticipated that the properties of the foot engaging member 40, such as the trough 44, feet, 48 and 50 and projecting member 58 may be incorporated into a shoe binding. The components of the present invention may be of corrosion resistant metal, structural plastic or a combination of those materials.

While one preferred embodiment for a releasable mounting for a snowboard binding has been shown, it is anticipated that some of the features may be reversed. For example the base member may be attached to the binding and the foot engaging member may be attached to the snowboard.

Directional terms such as "front", "back", "in", "out", downward, and the like are applicable to the embodiments shown and described in conjunction with the drawings. These terms are merely used for the purpose of description in connection with the drawings and do not necessarily apply to the position in which the releasable mounting for a snowboard binding of the present invention may be used.

While these particular embodiments of the present invention have been shown and described, it is to be understood that the invention is not limited thereto and protection is sought to the broadest extent that the prior art allows.

What is claimed is:

1. A releasable mounting for a snow board binding comprising a) a base member arrayed for attaching to a selected surface of a snowboard, the base plate further including a pair of spaced side wall members forming a channel profile, a top edge of each of said side wall members having a plurality of laterally disposed lug members which are in substantial alignment and have a predetermined spacing, said predetermined spacing forming gaps therebetween;

b) a foot engaging member having an elongated trough being formed along a major axis or its bottom surface, said elongated trough having sloped sides, said sloped sides being arrayed for forming an enlarged mouth portion, a plurality of laterally disposed feet, said feet being of a predetermined shape and being positioned at predetermined intervals along said mouth of said elongated trough, each of said feet being sized to fit into said gaps of said base member c) a locking means being carried by said base member, said locking means including a handle portion, an engaging portion and a biasing means, said locking means being manually movable from an open position to a closed position by way of said handle portion; said biasing means being adapted for maintaining said locking means in either said open position or said closed position: and wherein said feet of said foot engaging member are inserted through said gaps of said base member, subsequently said foot engaging member may be laterally displaced along said major axis to a position under said lug members for providing an engaged only condition when said locking means is in said open condition, said foot engaging member being held in an engaged and locked condition when said locking means is placed in a locked position.

2. A releasable mounting as recited in claim 1 wherein said feet project downward and outward from said elongated mouth portion.

3. A releasable mounting as recited in claim 2 wherein each of said feet further include a bottom surface which is sloped upwardly and outwardly with respect to an upper surface of said feet.

4. A releasable mounting as recited in claim 1 wherein said base member further includes a stop member for limiting the lateral displacement of the foot engaging member in at least one direction.

5. A releasable mounting as recited in claim 4 wherein said foot engaging member includes a projecting member, said projection member being sized and shaped for abutting said stop member of said base member.

6. A releasable mounting as recited in claim 1 wherein said engaging portion of said locking means includes a radial portion for abutting one of said feet when in said locked condition.

7. A releasable mounting as recited in claim 1 wherein said biasing means is an extension spring, one end of said extension being attached to said base member and a second end of said extension spring being attached to said locking means.

* * * * *